United States Patent [19]

Spraggs et al.

[11] 3,987,733

[45] Oct. 26, 1976

[54] MILLISECOND DELAY SURFACE CONNECTOR

[75] Inventors: Richard William Spraggs, Simsbury; Ernest Laird Gladden, Granby, both of Conn.

[73] Assignee: The Ensign-Bickford Company, Simsbury, Conn.

[22] Filed: Feb. 10, 1975

[21] Appl. No.: 548,292

[52] U.S. Cl. ..... 102/27 R; 102/22 R

[51] Int. Cl.[2] ..... C06C 5/06

[58] Field of Search ..... 102/22, 27 R, 27 I, 102/28 R, 28 M

[56] References Cited

UNITED STATES PATENTS

| | | | |
|---|---|---|---|
| 927,968 | 7/1909 | Harle | 102/27 R |
| 3,420,174 | 1/1969 | Potter | 102/28 R |
| 3,590,739 | 1/1971 | Persson | 102/27 R |
| 3,669,021 | 6/1972 | Spencer et al. | 102/22 |
| 3,709,149 | 1/1973 | Driscoll | 102/22 |
| 3,739,724 | 6/1973 | Tlam | 102/28 R |
| 3,878,785 | 4/1975 | Lundborg | 102/27 R |

*Primary Examiner*—Verlin R. Pendegrass

*Attorney, Agent, or Firm*—Prutzman, Hayes, Kalb & Chilton

[57] ABSTRACT

A millisecond delay surface connector suited for explosive blasting operations is provided in the form of a flexible detonation transmitter tube having a length of about one half foot and more with a delay cap connected to each end of the tube. The tube provides a hollow elongated gas channel having the inside periphery of said tube coated with a layer of explosive for sustaining a percussion wave at high velocity along the length of the tube. Each cap includes an elongated tubular shell of rigid material having a closed terminal end portion, a layer of explosively inert material within the shell at the terminal end portion, a delay element within the shell and a detonating charge intermediate to said delay element and said explosively inert layer. The delay element is in propagative relationship with the tube and the detonating charge. A protective block housing each cap has several elongated cavities in side-by-side communicating relationship with the cap being retentively received in one of the cavities and the other cavities being suited to receive a detonating fuse in side-by-side relationship with the cap.

15 Claims, 3 Drawing Figures

MILLISECOND DELAY SURFACE CONNECTOR

BACKGROUND AND SUMMARY OF THE INVENTION

The present invention relates generally to surface delay connectors for explosive blasting operations and is more particularly concerned with a new and improved millisecond delay surface connector unit that exhibits a wide flexibility of applications in blasting operations.

At present, surface delay connector devices used in blasting operations are almost exclusively of the bidirectional type since they eliminate the possibility of inadvertant hook-up in the wrong direction or the need for even considering the direction of propagation of the detonating impulse. These bidirectional delay connectors generally function properly when actuated from either end and are widely used to introduce appropriate time delay intervals between the initiation of selective explosive charges. Heretofore, such connectors have taken the form of relatively short shell-like metal tubes containing detonating charges on opposite ends with at least one time delay element between the explosive charges. The tubular connectors are generally open at both ends and are connected to a length of explosive cord, such as detonating fuse, through either a butt connection with the detonating charge or a lateral or side connection with the connector. The delay in detonation transmission is provided primarily by the delay element or portion thereof located adjacent the output end of the connector while the delay element or portion adjacent the input end of the connector is usually overridden or destroyed.

As will be appreciated, in a bidirectional connector it is necessary for the input end and the output end to have substantially the same characteristics in order to effect the bidirectional character of the delay unit. Accordingly, each end requires both sufficient sensitivity to pick up the explosive transmission signal and sufficient power to provide the requisite signal output. Additionally, such devices contain sufficient explosive material that, when closely packaged, they are subject to sympathetic detonation under impact or fire conditions. Further, since they are designed for use with detonating cord, they cannot be preassembled with the cord but must be spliced into a previously set out detonating cord trunkline that functions at a relatively high noise level.

Accordingly, it is an object of the present invention to provide a new and improved millisecond delay connector that is a reliable, safe and practical unit of far greater simplicity and versatility yet effectively provides the bidirectional delay connector function.

Another object of the present invention is to provide a delay connector of the type described wherein the explosive content of the assembly may be significantly lower than presently available commerical connectors. Included in this object is the provision for a device that will not sympathetically detonate due to fire or impact thus providing more favorable and economical shipping rates and added safety at the blasting site.

A further object of the present invention is to provide a surface delay connector capable of functioning as a replacement or substitute for a substantial portion of the detonating cord trunkline. Included in this object is the provision for a delay connector that not only operates as a trunkline at high velocity signal transmitting speed but which also achieves this function at a substantially lower noise level and in fact provides a trunkline function in essentially a noiseless manner.

A still further object of the present invention is to provide a connector of the type described which is capable of providing both the delay connector and trunkline functions and is also capable of functioning bidirectionally or in only a single direction without substantial modification to the unit.

Still another object and advantage of the present invention is to provide a millisecond delay connector unit which can be preassembled, packaged and shipped with the signal transmission tube in such a manner that both the connector and the tube are fully sealed from the atmosphere under controlled factory conditions. Included in this object is the provision for a connector that obviates the possibility of improper splicing into a detonating cord trunkline or inadvertent introduction of foreign matter that might totally or partially disrupt the time intervals between explosive charges in a blasting operation.

Other objects will be in part obvious and in part pointed out more in detail hereinafter.

These and related objects are accomplished in accordance with the present invention by providing a millisecond delay surface connector comprising a flexible explosive signal transmitting fuse of about one half foot in length or longer and a signal delaying and amplifying cap on each end thereof. The fuse includes an elongated hollow gas channel along its entire length and is adapted for sustaining a percussion wave at high velocity and low noise level. Each signal transmitting cap is secured to the fuse and housed within a protective block that also functions to provide secure interconnection with a length of detonating cord or similar signal transmitting element while at the same time providing a protective housing for the cap to substantially reduce sympathetic detonation between packaged multiples of similar assemblies.

A better understanding of the invention will be obtained from the following detailed description and the accompanying drawing of an illustrative application of the invention.

DETAILED DESCRIPTION

Figures 1, 2, 3:
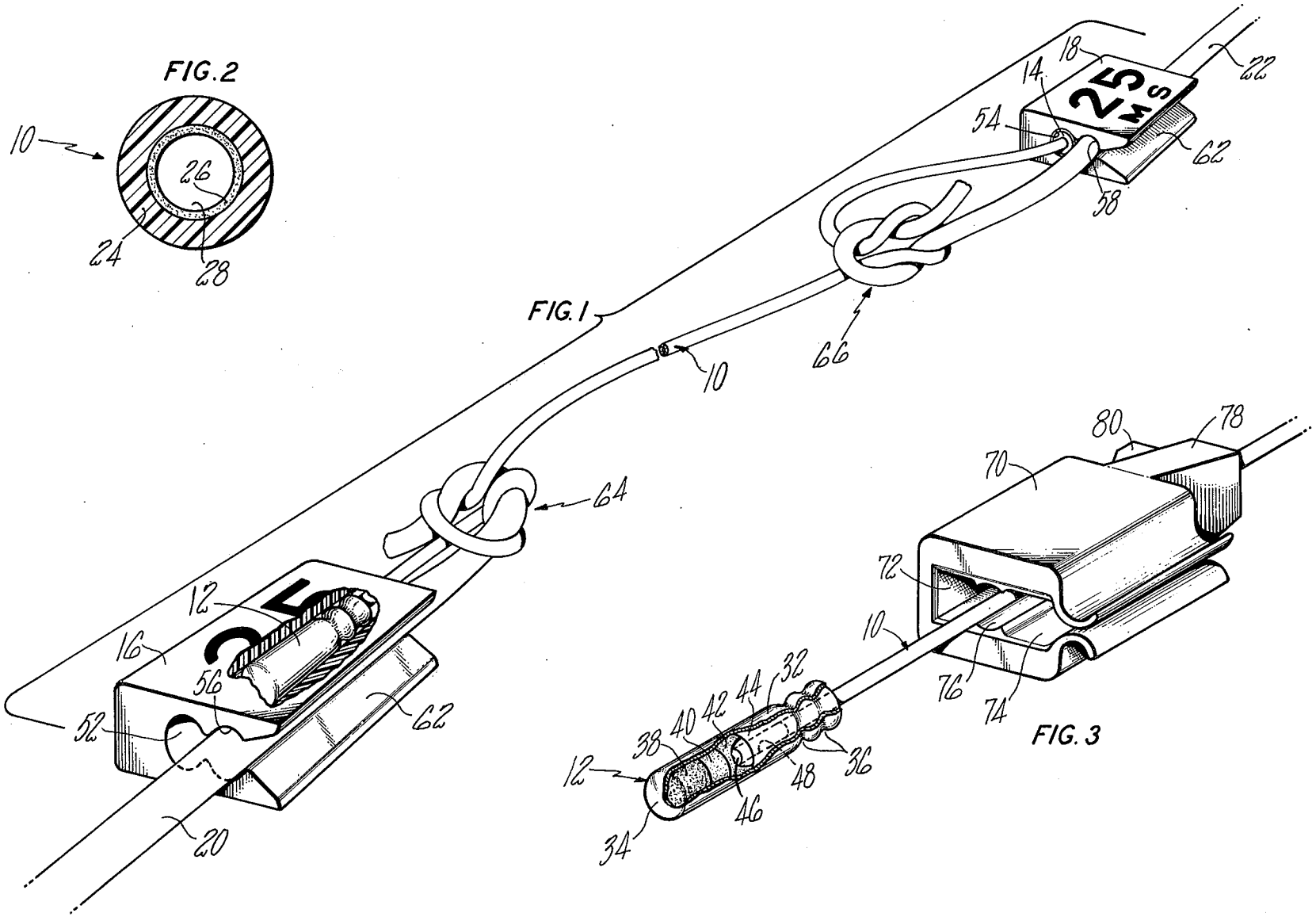
FIG. 1 is a perspective view partially broken away and partially in section of the bidirectional millisecond delay surface connector of the present invention in its assembled relationship within a detonating cord trunkline system.
FIG. 2 is an enlarged cross sectional view of the central signal transmitting fuse portion of the connector of FIG. 1.
FIG. 3 is a perspective partially disassembled view of one signal amplifying cap assembly of the delay connector, partially broken away and partially in section, with an alternative embodiment of a protective cap block.

Referring now to the drawing in greater detail wherein like reference numerals indicate like parts throughout the several figures, the millisecond delay connector of the present invention is shown as consisting essentially of a length of flexible signal transmitting fuse, duct or tubing 10 with signal amplifying caps 12, 14 secured to opposite ends thereof. The caps 12, 14 are protectively enclosed within individual generally rectangular plastic blocks 16, 18, respectively, configured so as to protectively house the caps while at the same time providing means for secure but ready attachment of lengths of detonating cord 20, 22, such as detonating fuse sold by Ensign-Bickford Co. of Connecticut under the name "Primacord".

The signal transmitting fuse 10 of the assembly is a relatively long flexible duct-like tubular member having a length of about one half foot or more and preferably about 1 to 20 feet or more and is made of a flexible material that possesses a limited degree of elasticity. For example, the signal transmitting tube 10 can be made from a tubular member 24 of tough, durable plastic such as polyethylene, polyvinyl chloride or similar materials. For example, the ionic polyethylene sold by E. I. duPont under the name "Surlyn" has been used with success. While the cross sectional dimensions of the tube 24 may vary, it should be of a size that will accommodate a thin coating 26 of granular explosive material on the interior wall yet leave a continuous hollow central gas chamber 28 extending axially therealong. Thus a tube of less than about 10 millimeters o.d. and preferably less than 5 millimeters o.d. may be conveniently used. Tubing of 3 millimeters o.d. and 1.5 millimeters i.d. have given excellent results.

The thin layer 26 of explosive may be of fine granular material and should be present in a sufficient amount to sustain a percussion wave of high velocity along the entire length of the plastic fuse 10. The thin layer 26 of explosive may include particulate high explosives such as PETN, RDX, HMX or the like and preferably the fuse is of the type described in greater detail in U.S. Pat. No. 3,590,739, the contents of which is incorporated herein by reference. Thus the explosive within layer 26 is generally less than 0.5 grams per meter and preferably well below 0.1 grams per meter. As will be appreciated the amount of explosive will vary somewhat with the diameter of the plastic tube. For example, an explosive mixture of about 0.05 grams per meter would be adequate for a 3 millimeter i.d tube while a core load of about 0.02 grams per meter is preferred for a 1.5 millimeter i.d. tube. The explosive layer is about one particle thick and provides a wave transmission velocity of about 2,000 meters per second.

As mentioned, the length of signal transmitting tubing 10 between the end caps 12, 14 of the connector unit can be as short as about one half foot in length or can be of any suitable long length thereby rendering the unit capable of functioning as an explosive signal transmitting trunkline as well as a delay connector. However, as will be appreciated, one of the advantageous features of utilizing the tube 10 for the signal transmission function is its inherent noiseless character and insensitivity to initiation by fire or impact. Thus it can be used in areas where excessive noise is objectionable and, of course, it lends itself to the safety and reliability associated with factory assembly as opposed to on-site assembly. More importantly, it provides confined signal transmission and will not cause side initiation of detonating cord or the like.

Each signal amplifying cap of the connector assembly is substantially identical and in the preferred embodiment the delay elements on opposite ends of the duct 10 preferably provide an equal time delay in explosive signal transmission thus assuring proper functioning of the connector regardless of the direction of hook-up with the detonating cords 20, 22.

As best seen in FIG. 3, the delay amplifier cap 12, and therefore the caps at each end of the bidirectional millisecond connector, consists essentially of a metal cap shell 32 of tubular configuration that is closed at its free end 34 and is crimpably connected at its opposite end, as by the crimps 36, to the butt end of the signal transmitting tube 10. A suitable explosively inert filler layer 38 is positioned within the shell 32 at the closed end 34 to promote the preferred side initiating function of the cap. The inert filler functions to minimize the detonation effect of the cap thereby reducing the probability of mass detonation in a fire during shipping and minimizing a shrapnel effect off the end of the cap possibly cutting a detonating cord trunkline. This explosively inert material can be any one of a variety of materials well suited for that purpose, such as particulate or foam plastic, sugar, diatomaceous earth of similar material of a granular consistency.

Immediately adjacent and in abutting relationship with the inert filler layer 38 at the closed or free end 34 of the cap is a signal amplifying main explosive charge 40. This charge may be any one of the conventional types commonly used in the explosive industry and can consist of organic nitrates, nitro compounds, organic and inorganic azides including RDX, HMX, PETN, and similar explosive or mixtures thereof that may be aluminized or treated with anti-static agents, flow aids or similar additives. When the main explosive charge is PETN or the like, it is generally preferred to provide a top charge or layer 42 of an initiating explosive mixture such as lead azide. As will be appreciated, other primary explosives may be used in place of the lead azide, such as lead styphnate, DDNP, HNM or other similar sensitive explosive materials or mixtures thereof. These explosives also may include additives of the type mentioned hereinbefore.

As best shown in FIG. 3 a bushing or adapter 44 is positioned immediately adjacent and in contact with the top charge 42. The adapter 44 is a plastic tubular member capable of housing a delay charge 46 along its central or axial cavity 48. As will be appreciated, a bushing of the type shown may not be required where the delay element is of a different size or shape. However, it is generally necessary to provide a bushing which will accept an end portion of the signal transmission tube 10 so as to provide a positive signal transmitting and propagating connection between the tube 10 and the delay element 46 and between the element 46 and charge 42. The bushing can be constructed of any suitable plastic materials such as polyolefins, rubber, ABS, nylon, vinyl or copolymers thereof such as an ethylene vinyl acetate copolymer. The bushing 44 is primarily used for the purpose of adapting the tube 10 and/or the delay element 46 to the cap shell 32. The delay element itself may be either in the form of a pressed pyrotechnic charge or pellet similar in size and shape to the explosive layers 40 and 42 or it may be an elongated sheathed pyrotechnic material that is preloaded within a lead or aluminum tube or within some other suitable sheathing material. As shown, the signal transmitting tube 10 positioned within the axial cavity 48 of the bushing 44 is retained therein by means of the crimp 36 applied to the outer shell 32 of the cap adjacent its open end.

The pyrotechnic delay element 46 may be formed of conventional delay compositions and may consist of suitable mixtures of boron, tungsten, titanium, zirconium, silicon, molybdenum, barium chromate, lead oxides, alkaline metal nitrates, chlorates, perchlorates or other suitable well known materials.

As illustrated in FIG. 1, the connecting blocks 16 and 18 of the connector unit provide for intimate side-by-side, substantially parallel alignment between the signal amplifying and transmitting caps 12, 14 and the respective detonating cords 20, 22 so as to positively assure signal transmission therebetween. Thus the blocks 16, 18 provide the dual function of protectively enclosing the caps 12, 14 while at the same time aligning the detonating cord therewith. The blocks 16, 18 are identical and can take the form of generally rectangular plastic members of polyethylene or similar protective plastic material that have central apertures 52, 54, respectively, extending longitudinally along the block for receiving the respective signal transmitting caps 12, 14. Aligned longitudinally extending cavities 56, 58 are provided immediately adajcent their respective central apertures and are in full communicating relationship therewith along the entire length of the blocks. The side apertures are of sufficient size to accommodate conventional detonating cord and, as shown, the blocks each may be provided with a tapered or ramp-like side notch 62 that provides communication between the exterior of the block and the side aperture to permit the detonating cord to be easily and readily snapped into position within the second cavity of the protective plastic housing. Preferably, as shown in FIG. 1, the free end of the detonating cord 20 extends well beyond the apertured block for a sufficient distance to permit it to be tied to the signal transmission tube 10 of the delay connector device by means of a square knot 64 or other suitable interentwinement. The opposite end of the connector is similarly connected in substantially the same manner to cord 22 through square knot 66.

As will be appreciated from the foregoing description, the connector function can be achieved regardless of which length of detonating cord is providing the input signal. Assume for purposes of illustration that the cord 22 on the right of FIG. 1 is providing the input. Then actuation of cord 22 will cause substantially simultaneous initiation of the signal transmitting cap 14 through side initiation and of the signal transmitting fuse or tube 10 through the square knot connection 66. The delay element housed within that signal transmitting cap 14 is bypassed by initiation of fuse 10 at the square knot 66. The percussive wave initiated at knot 66 will travel along the length of the signal transmitting fuse or tube 10 to the delay amplifying cap 12 located on the left in FIG. 1. Since the signal transmitting tube 10 is incapable of providing lateral or side initiation of the detonating fuse 22, the explosive signal will pass through the square knot connection 64 without initiating the detonating cord 20. Instead, the signal transmitting tube will initiate operation of the delay element 46 within the delay amplifier cap and only after the appropriate delay interval will it effect initiation of the primary charge 42 and amplifying main charge 40 housed within the cap 12 to provide side initiation of the detonating cord trunkline 20 connected thereto by means of block 16.

As mentioned hereinbefore, the housing or block for the delay transmitter cap may be constructed of a suitably durable plastic material, such as polyethylene, vinyl, nylon, ABS or other protective material which will provide both a sufficient degree of flexure to allow seating of the cap within the central cavity thereof and sufficient resistance to flexure to maintain secure retention of the cap in the block as the detonating cord trunkline is snapped into position in abutting relationship therewith. The housing block may assume a variety of different shapes depending on the anticipated use of the millisecond delay connector. Thus, as shown in FIG. 2, a block 70 may be provided to include a pair of side cavities 72, 74 on opposite sides of a central cavity 76 housing the delay transmitting cap 12. The block may be constructed in such a manner that only one side cavity 74 would provide for the snap-in insertion of the detonating cord while the opposite cavity 72 would permit threaded attachment of a similar or different unit or to a length of signal transmission tubing of the type described in U.S. Pat. No. 3,590,739. In such an arrangement it is frequently desirable to provide a stabilizing end lug 78 to control the flexibility of the housing block 70 and a lateral flange or tail 80 around which the signal transmission tube may be wrapped in order to assure retention thereof within the cavity 72 of block 70.

As will be appreciated where long lengths of signal transmission tube 10 are provided between the delay amplifying caps 12, 14, it is possible to cut the signal transmission fuse at an intermediate point along its length, such as between the square knot 66 and cap 14, and simply connect the detonating cord thereto by means of a square knot or other similar interentwinement. This, of course, would eliminate the bidirectional characteristic of the device and rendering it unidirectional only. Necessarily, such an arrangement would require greater care to ensure proper directional firing. However, it has definite cost advantages to the user where only unidirectional delay patterns are used. As will be appreciated, the cut end should be properly sealed to avoid the possibility of foreign matter entering the cut tube and hampering its operation.

As will be apparent to persons skilled in the art, various modifications, adaptations and variations of the foregoing specific disclosure can be made without departing from the teachings of the present invention.

We claim:

1. A bidirectional millisecond delay surface connector suited for trunkline explosive blasting operations comprising a flexible detonation transmitter duct having a length of about one half foot and more and providing a hollow elongated interior gas channel, said duct having means about the periphery of said channel for sustaining a percussion wave at high velocity along the length of said duct, a delay cap connected to each end of said duct and terminating said channel, each of said caps comprising an elongated tubular shell of rigid material having a closed terminal end portion, a layer of explosively inert material within said shell at said terminal end portion, a delay element within said shell and a detonating charge intermediate said delay element and said explosively inert layer, said channel facing generally toward said delay element for directing said wave toward said element, said delay element being in propagative relationship with said duct and said detonating charge, said detonation transmitter duct being incapable of side initiating a detonating cord and of being initiated by said delay element, and a protective block for housing each cap, said block having a pair of elongated cavities in side-by-side communicating relationship, said cap being retentively received in one of said cavities, the other of said cavities being suited to receive a detonating fuse in side-by-side relationship with said cap.

2. The connector of claim 1 wherein said delay elements provide the same time delay interval for each cap.

3. The connector of claim 1 wherein said delay caps include a primary explosive charge between said delay element and said detonating charge.

4. The connector of claim 1 wherein said flexible detonation transmitter duct has a length of at least 1 foot and said sustaining means includes an explosive having a core load of less than 0.5 grams per meter.

5. The connector of claim 1 wherein said hollow elongated interior gas channel has a diameter of less than about 3.0 millimeters and said wave sustaining means includes a particulate explosive layer defining said channel.

6. The connector of claim 1 wherein said flexible detonation transmitter duct is a plastic tube having a length of at least about 3 feet and said wave sustaining means includes a particulate explosive having a cord load of less than 0.1 grams per meter.

7. The connector of claim 1 wherein the delay elements in each cap provide a different time delay interval.

8. The connector of claim 1 wherein said protective block is a plastic member of generally rectangular configuration with said cavities extending longitudinally thereof.

9. The connector of claim 1 wherein said block is constructed of durable flexible material and one of the cavities in said block is open along its entire length for retainably receiving a length of explosive cord.

10. The connector of claim 1 wherein said block is provided with three elongated side-by-side cavities with said cap being received in the central cavity.

11. The connector of claim 1 wherein said detonating charge is PETN and said cap includes a charge of lead azide intermediate said delay element and said PETN.

12. The connector of claim 1 wherein said cap includes a layer of explosively inert material within said shell intermediate said detonating charge and said terminal end portion.

13. The connector of claim 1 wherein said duct is severed at an intermediate point along its length to render the connector unidirectional.

14. A bidirectional millisecond delay surface connector suited for trunkline explosive blasting operations comprising a flexible detonation transmitter duct having a length of about one half foot and more and providing a hollow elongated interior gas channel and a pair of delay caps connected to opposite ends of said duct and terminating said channel; said duct having means about the periphery of said channel for sustaining a percussion wave at high velocity along the length of said duct; each of said caps comprising an elongated tubular shell of rigid material having a closed terminal end portion, a layer of exposively inert material within said shell at said terminal end portion, a delay element within said shell and a detonating charge intermediate said delay element and said explosively inert layer; said channel facing generally toward said delay element for directing said percussion wave toward said element; said delay element being in propagative relationship with said duct and said detonating charge, said detonation transmitter duct being incapable of side initiating a detonating cord and of being initiated by said delay element to assure directional functioning of the connector.

15. The connector of claim 14 including attaching means for retentively securing said cap to a detonating fuse.

* * * * *